US006642160B1

(12) United States Patent
Takahashi

(10) Patent No.: US 6,642,160 B1
(45) **Date of Patent: *Nov. 4, 2003**

(54) LOOP MATERIAL OF HOOK-AND-LOOP FASTENER AND MANUFACTURING PROCESS THEREOF

(75) Inventor: Tohru Takahashi, Aichi (JP)

(73) Assignee: Unitika Ltd., Hyogo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/035,021

(22) Filed: Mar. 5, 1998

(30) Foreign Application Priority Data

Mar. 5, 1997 (JP) ..... 9-069259
Aug. 4, 1997 (JP) ..... 9-223105

(51) Int. Cl.[7] ..... D04H 3/08; D04H 3/10; D04H 11/08; A44B 18/00; B32B 3/02

(52) U.S. Cl. ..... 442/336; 442/335; 442/361; 442/364; 442/402; 428/92; 24/446; 28/107; 28/112; 28/161

(58) Field of Search ..... 428/99, 100, 92; 442/101, 334, 335, 336, 337, 361, 364, 402; 24/442, 446, 449, 451; 28/161, 107, 112

(56) References Cited

U.S. PATENT DOCUMENTS 3,522,637 A * 8/1970 Brumlik ..... 24/204
3,748,701 A * 7/1973 De Mestral ..... 24/204
4,451,314 A * 5/1984 Knoke et al. ..... 156/148
4,490,425 A * 12/1984 Knoke et al. ..... 428/90
5,326,612 A * 7/1994 Goulait ..... 428/100
5,616,394 A * 4/1997 Gorman et al. ..... 428/99
5,773,120 A * 6/1998 Deka et al. ..... 428/99
5,786,060 A * 7/1998 Takahashi et al. ..... 428/89
5,891,547 A * 4/1999 Lawless ..... 428/92

FOREIGN PATENT DOCUMENTS

JP 07-313213 * 12/1995
WO WO 00/31330 * 6/2000

OTHER PUBLICATIONS

Table A5–2, "Typical Properties of Representative Textile Fibers," F. Rodriguez, Principles of Polymer Systems, 2nd ed., pp. 538–539.*

* cited by examiner

*Primary Examiner*—Cheryl A. Juska
(74) *Attorney, Agent, or Firm*—Jones, Tullar & Cooper, P.C.

(57) ABSTRACT

A loop material of a hook-and-loop fastener, comprised of a nonwoven base and a number of loops which are formed at least on one plane side of the nonwoven base. The nonwoven base is formed by accumulating a number of filaments or fibers. An antislipping agent is deposited at least on the surface of the loops, thereby the surface of the loops become uneven. Or, by deformation on the surface of the loops due to thermal plasticity, the surface of the loops become uneven. Due to this unevenness, projections of the hook material are difficult to get out of the loops and a hook-and-loop fastener having high joining strength is obtained.

11 Claims, 8 Drawing Sheets

LOOP MATERIAL OF HOOK-AND-LOOP FASTENER AND MANUFACTURING PROCESS THEREOF

BACKGROUND OF THE INVENTION

1. Technical Field of the Invention

The present invention relates to a loop material of a hook-and-loop fastener serving as a fastener and, more particularly, to a loop material of a hook-and-loop fastener applied to disposable goods such as diapers, operating gowns, and the like. The present invention relates also to a manufacturing process of such a loop material of a hook-and-loop fastener.

2. Prior Art

A hook-and-loop fastener comprises a sheet-like or tape-like loop material having a large number of loop-shaped or arch-shaped engaged members on its surface and a sheet-like or tape-like hook material having a large number of mushroom-shaped or hook-shaped projections on its surface, and provides a fastener function by engaging the projections of the hook material with the engaged members of the loop material. The hook-and-loop fastener is employed in a varieties of uses such as clothing, daily necessaries, interior materials, industrial materials, etc., because of its simple and easy way of use, as compared with other fasteners.

Generally, a sheet or tape of synthetic resin such as nylon, polyethylene, polypropylene, on the surface of which a large number of mushroom-shaped or hook-shaped projections are formed, is employed as a hook material On the other hand, a pile woven or knitted fabric having a large number of loops (piles) on its surface which is obtained by weaving or knitting synthetic multifilaments or monofilaments of nylon, polyester, polypropylene, etc., is employed as a loop material.

When joining by pressing such a hook material to a loop material, very high joining strength (high peeling strength and high shearing strength) may be obtained. Even when repeating the joining by pressing, the high joining strength may be maintained, and the hook-and-loop fastener has high joining durability.

However, when a hook-and-loop fastener is applied to disposable goods such as diapers, operating gowns, the hook-and-loop fastener is in most cases thrown away after one time or several times of use together with the disposable goods, and therefore the high joining durability is not always required. It may be said that the application of the mentioned hook-and-loop fastener to the disposable goods is more than enough quality and is not always reasonable. Since the quality is more than enough, the price is high, and therefore the application of the high quality hook-and-loop fastener to disposable goods is not economical.

Under such circumstances, several hook and hoop materials of a hook-and-loop fastener for use in disposable goods such as diapers, operating gowns, etc., have been heretofore proposed. In particular, a loop material composed of filamentous nonwoven fabric having wrinkle portions (Japanese Patent Laid-Open Patent Publication No. 6-33359) and another loop material composed of a nonwoven fabric on the surface of which loops are formed by needle-punching a nonwoven web (Japanese Patent Laid-Open Patent Publication No. 7-171011 and 9-317) were proposed. The loop materials composed of the above-mentioned nonwoven fabrics are economical from the viewpoint of price, and not having high joining durability, the loop materials are suitable for disposable goods.

However, since the projections of the hook material are engaged with the wrinkle portions or loop portions which are formed of filaments or fibers, there is a disadvantage of poor joining strength. That is, since the surface of the filament or fiber is generally smooth and the coefficient of friction thereof is small, there arises a problem that the projections of the hook material once engaged are easy to remove from the loops so that it is difficult to obtain high joining strength. Accordingly, when such a loop material is applied to the hook material for engagement, there is a disadvantage that if a shearing load (external load produced horizontally in the face direction of the hook material and loop material) or a peeling load (external load produced vertically in the face direction of the hook material and loop material) is applied after joining, the hook and loop materials are disjoined from each other. It is certain that high joining durability is not required in the disposable goods, but high joining strength is essential

SUMMARY OF THE INVENTION

Accordingly, an object of the present invention is to provide a loop material of a hook-and-loop fastener composed of a nonwoven fabric in which a surface of the loop (hereinafter referred to as "loop surface") formed at least on one face of the nonwoven fabric is made unevenly by various means so that the coefficient of friction between the projections and loops may be increased, whereby the projections are hard to remove from the loops after engagement with each other.

To accomplish the foregoing object, means are provided for making the surface of the loop uneven by applying an antislipping agent to the loop surface, and a means for making the surface of the loop uneven by employing conjugate filaments or fibers composed of a low melting point polymer and a high melting point polymer as filaments or fibers forming the loop in which the low melting point polymer is deformed by softening or melting.

The former is a loop material of a hook-and-loop fastener composed of a base of nonwoven fabric formed by accumulating a large number of filaments or fibers, and a large number of loops formed by partially protruding the filaments or fibers at least on one plane side of the nonwoven base, and an antislipping agent is applied to at least one part of each loop surface.

On the other hand, the latter is a loop material of a hook-and-loop fastener composed of a base of nonwoven fabric formed by accumulating conjugate filaments or fibers each of which is formed of a high melting point polymer and a low melting point polymer occupying at least one part of the surface of the filament or fiber, and a large number of loops formed by partially protruding the filaments or fibers at least on one plane side of the nonwoven base, and unevenness of the surface of the loop is formed by softening or melting the low melting point polymer.

DETAILED DESCRIPTION

Figure 1:
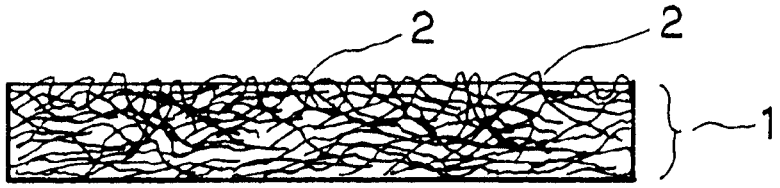
FIG. 1 is a schematic sectional view showing conceptually a section of the loop material of a hook-and-loop fastener according to an example of the present invention.

A loop material of a hook-and-loop fastener according to the present invention is composed of a nonwoven base formed by accumulating a large number of filaments or fibers, and a large number of loops formed on at least one plane side of the nonwoven base. The loop material generally has a weight of about 30 to 100 g/m$^2$, and preferably about 50 to 80 g/m$^2$. FIG. 1 shows schematically a side of such a loop material and in which reference numeral 1 designates a nonwoven base and numeral 2 designates loops. The nonwoven base is composed of a large number of accumulated filaments or staple fibers, and a mixture of filaments and staple fibers is also preferred. Since a part of each filament or fiber is utilized to form the loop, it is generally more preferable to employ the filaments, because when employing the fibers, an end of the fiber is easy to protrude out of the nonwoven base, and it generally becomes difficult to form a semi-annular loop. Moreover, the loops formed of fibers are easy to drop out of the nonwoven base at the time of peeling after engaging with the hook material, and the fibers are easy to stick to the hook material. Once the fibers stick to the hook material performance of the projections of the hook material is lowered, and though there may be no problem in using such a hook-and-loop fastener only one time, any high joining strength will not be obtained in using the hook-and-loop fastener on and after a second time.

As the filament or fiber, any of the conventionally known filaments or fibers may be employed, for example, natural fiber, regenerated filament or fiber, synthetic filament or fiber may be employed. Both filament or fiber composed of only one type of polymer and conjugate filaments or fibers composed of two or more types of polymers are preferably used as the synthetic filament or fiber.

Various thermoplastic filaments or fibers including filaments or fibers of polyester such as polyethylene terephthalate, polybutylene terephthalate, filaments or fibers of polyamide such as nylon 6, nylon 66, filaments or fibers of polyolefin such as polyethylene, polypropylene, filaments or fibers of biodegradable polyester such as polylactic acid, polybutylene succinate, polyethylene succinate, is preferably used as the filaments or fibers composed of only one type of polymer. In this respect, the term "polyester" means an aromatic polyester which is not biodegradable, and the "biodegradable polyester" means an aliphatic biodegradable polyester. Among those thermoplastic filaments or fibers, it is most preferred to employ polyester filaments or fibers of low elongation and superior in dimensional stability, in particular polyester filament. Since the loop is formed of the filament, the filament which is difficult to elongate at the time of engaging with the hook material is more preferable.

On the other hand, as the conjugate filaments or fibers, it is preferred to employ conjugate filaments or fibers composed of a high melting point polymer and a low melting point polymer. Examples of conjugation of the high melting point polymer and the low melting point polymer are polyester/polyolefin, high melting point polyester/low melting point polyester, polyamide/polyolefin, high melting point polyamide/low melting point polyamide, polypropylene/polyethylene, high melting point biodegradable polyester/low melting point biodegradable polyester, etc. Examples of the conjugation type are the sheath-core type (including both eccentric sheath-core type and concentric sheath-core type), the side-by-side type, the sea-island type, the sectional multi-foliate type, etc. In these types of conjugation, it is preferred to use a conjugation in which the low melting point polymer occupies at least one part of the surface of the filaments or fibers.

Particularly preferable conjugate filaments or fibers is a sheath-core type conjugate filament or fiber which is composed of a core component of polyester being a high melting point polymer, and a sheath component of polyolefin being a low melting point polymer. This is because the core component of polyester is low in elongation and superior in dimensional stability. As the polyester, polyethylene terephthalate or copolymeric polyester of which the main multiple unit is ethylene terephthalate may be used. As the component copolymerized with ethylene terephthalate, any conventional acid component and/or glycol component may be used. As the acid component, isophthalic acid, adipic acid, etc., may be used. As the glycol component propylene glycol, diethylene glycol, etc., may be used. As the polyolefin, linear low density polyethylene, high density polyethylene, medium density polyethylene, low density polyethylene, polypropylene, ethylene-vinyl acetate copolymer, etc., may be used.

When the sheath-core type conjugate filament or fiber is used as the conjugate filament or fiber, it is preferred that the ratio by weight of the core component to the sheath component is in the range of 1: 0.2 to 5=core conponent: sheath component. If the amount of the sheath component is more than this range, the entire conjugate filament or fiber is easy to deform when heat is applied, and it becomes difficult to produce unevenness on the surface of the filaments or fibers. On the other hand, if the amount of the sheath component is less than this range, deformation on the surface of the conjugate filaments becomes insufficient when heat is applied, and it becomes difficult to produce enough unevenness to antislip on the surface of the filament or fiber.

Fineness (denier) of various filaments or fibers (monophase filaments or fibers, conjugate filaments or fibers, etc.) is preferably about 2 to 10 denier, and more preferably about 5 denier. If less than 2 denier, the tensile strength of the filaments or fibers is decreased, and when an external load is applied after the engagement with the hook material, the loops are easily broken, thereby decreasing the joining strength. On the other hand, if more than 10 denier, rigidity of the filaments or fibers is increased, and the flexibility of the loop material is decreased. A cross-sectional view of the mentioned various filaments or fibers is not limited to a circle but may be any modified cross-sectional view including a triangle, a square, a #—shape, an ellipse, an oblate, a cross, a multi-foliate, etc. Further, the filaments or fibers may be hollow (cross-sectional view may be circular or any other modified cross-section). In particular, as the hollow filaments or fibers have a large recovery force from bending, the loop formed of the hollow filaments or fibers easily recover their original shape, and are suitable for use in the loop material, even when various deformations are applied to it. It is also preferred to use the filaments or fibers of modified cross-section, as far as the filaments or fibers have a large recovery force from bending, for the same reason as the hollow filaments or fibers.

The nonwoven base is formed by accumulating the filaments or fibers as mentioned above, and it is preferred that the filaments or fibers are fixed to each other to a certain extent by bonding and/or entangling by any of the conventional methods, whereby the nonwoven base maintains a physical stability. To bond the filaments or fibers to each other, any of the conventional methods for producing a nonwoven fabric may be used. For example, it is preferred to bond the filaments or fibers to each other by applying a binder resin. In case of employing thermoplastic filaments or fibers, it is also preferred to heat-bond the filaments or fibers to each other by softening or melting of the thermoplastic filaments or fibers. In case of employing the conjugate filaments or fibers composed of a high melting point polymer and a low melting point polymer which occupies at least a part of the surface of the filaments or fibers, it is also preferred to heat-bond the filaments or fibers to each other by softening or melting of the low melting point polymer. It is also preferred to use more than one of the mentioned methods together.

For entangling the filaments or fibers to each other, any of the conventional methods for producing a nonwoven fabric may be employed. For example, the filaments or fibers may be entangled with each other by needle punching or water needling. It is also preferred to use both bonding and entangling together. For example, it is preferred to use three methods, i.e., bonding the filaments or fibers to each other by a binder resin, self-heat-bonding the thermoplastic filaments or fibers to each other or heat-bonding the conjugate filaments or fibers to each other by softening or melting the low melting point polymer, and entangling the filaments or fibers to each other by needle punching.

As the binder resin for bonding the filaments or fibers to each other, a polymer or copolymer obtained by polymerizing or copolymerizing one or more monomers such as methyl acrylate, ethyl acrylate, butyl acrylate, methyl methacrylate, ethyl methacrylate, butyl methacrylate, acrylo-nitrile, styrene, vinyl chloride, vinyl acetate, etc., at a desired mole ratio, or a cross linked polymer obtained by cross linking the mentioned polymer or copolymer with a cross linking agent, may be used. The amount of binder resin applied in the nonwoven base is preferably 3 to 25% by weight, and more preferably 5 to 20% by weight. If the amount of binder resin applied is less than 3% by weight, physical stability of the nonwoven base structure tends to be decreased. Furthermore, the loops are easy to get out of the nonwoven base, and the loops tend to elongate by any external load after the engagement of the loops with the projections of the hook materiaL On the other hand, if the amount of binder resin applied is more than 25% by weight, the flexibility of the nonwoven base tends to be decreased. When this method of bonding the filaments or fibers to each other by a binder resin is employed together with the other methods of self-heat-bonding the thermoplastic filaments or fibers to each other or heat bonding the conjugate filaments or fibers by softening or melting the low melting point polymer, entangling the filaments or fibers to each other by needle punching, etc., as the stability of the nonwoven base structure is maintained by each method, the amount of binder resin applied may be less than 3% by weight or 0% by weight, as a matter of course.

In case of self-heat-bonding the thermoplastic filaments or fibers to each other by softening or melting of themselves, or heat-bonding the conjugate filaments or fibers to each other by softening or melting the low melting point polymer, it is generally preferred that the filaments or fibers are self-heat-bonded or heat-bonded by forming the loops only on one plane side of the nonwoven base and applying heat from another plane side of the nonwoven base (the plane side not formed with the loops is hereinafter referred to as "non-loop side", and the plane side formed with the loops is hereinafter referred to as "loop side"). This is because if applying heat from the loop side, there is a possibility that the loops may be softened, molten, and deformed.

The large number of loops formed at least on one plane side of the nonwoven base are produced by partially protruding the filaments or fibers forming the nonwoven base. In this respect, the loop means a part of each filament or fiber existing in the nonwoven base and which is produced to be semi-annularly protruding out of the nonwoven base, and two ends of the semi-annular part (the loop) are embedded into the nonwoven base. For example, the semi-annular elements shown in FIGS. 2 to 6 and 8 to 12 are the loops. FIGS. 2 to 6 and 8 to 12 are schematic views showing a part of the nonwoven base and several loops taken by a microscopic photograph of 40 magnification. In most cases, the large number of loops are formed on one plane side of the nonwoven base, but they may be sometimes formed on both plane sides.

An antislipping agent is deposited to at least one part of the surface of the loop as shown in FIGS. 2 to 6. The antislipping agent is shown like small knobs or knots on the loops. The antislipping agent may be deposited on the entire surface of each loop or any part thereof. When depositing partially the antislipping agent, the mentioned knobs or knots are produced in the form of steps, and therefore the projections of the hook material are hard to slip, which results in improvement of the joining strength between the loop material and the hook material. Any material may be used as the antislipping agent as far as the material can increase a coefficient of friction of the surface of the filament or fiber forming the loop. In particular, the same materials as the mentioned binder resin are preferably used. For example, it is preferred to use a polymer or copolymer obtained by polymerizing or copolymerizing one or more monomers such as methylacrylate, ethylacrylate, butylacrylate, methylmethacrylate, ethylmethacrylate, butylmethacrylate, acrylonitrile, styrene, venial chloride, venial acetate, etc., or a cross linked polymer obtained by cross linking such polymer or copolymer. It is a matter of course that when two or more monomers are copolymerized, the monomers are combined at a desired mole ratio. In particular, when using a cross linked rubber polymer selected of a polyacrylic acid polymer group or polymethacrylic acid polymer group, antislipping effect is preferably improved due to its elasticity.

The amount of antislipping agent deposited on the surface of the loop is preferably 3 to 25% by weight, and more preferably 5 to 20% by weight. If the amount of antislipping agent deposited is less than 3% by weight, it becomes difficult to form the large number of thick bulge-like knobs or knots, and sufficient antislipping effect may not be performed. On the other hand, if the amount of antislipping agent applied is more than 25% by weight, an even film of the antislipping agent may be formed on the surface of the loop, and only a small number of knob-like or knot-like thick portions are formed, which results in a poor antislipping effect.

The method for depositing the antislipping agent on the surface of the loop may be performed by the means of heating or drying after spraying or coating a solution to the loops, or impregnating the loops into a solution. In the solution, an antislipping agent or a composite for producing the antislipping agent by heating, drying, etc., is dissolved or disposed (hereinafter referred to as "antislipping agent solution"). In the case of employing the same material as the binder resin, just by impregnating the nonwoven base precursor and the loops together into the antislipping agent solution, the filaments or fibers of the nonwoven base precursor may be bonded to each other with the binder resin and, at the same time, the antislipping agent may be deposited on the surface of each loop.

The loops shown in FIGS. 8 to 12 are formed of conjugated filaments or fibers composed of a high melting point polymer and a low melting point polymer which occupies at least one part of the surface of the filaments or fibers. Unevenness by softening or melting the low melting point polymer are formed on at least one part of the surface of the loop. The unevenness may be seen as a little light and shade by a microscope. In FIGS. 8 to 12, the unevenness is illustrated as shade portions by thick lines, while the light portions by thin lines. The unevenness may be formed entirely or partially on the surface of each loop.

To form the unevenness, each low melting point polymer in the conjugate filaments or fibers is softened or molten, and the conjugate filaments or fibers are heat-bonded to each other by partially applying a pressure or without pressure, thereafter such a heat-bonded area is broken (peeled), whereby the unevenness are formed at the broken part. As the conjugate filaments or fibers, when employing the sheath-core type conjugate filaments, the sheath component of which is composed of the low melting point polymer, it becomes possible to form the unevenness on the entire surface of the filaments or fibers. Thus a large number of unevenness may be formed. Alternatively, as the conjugate filaments or fibers, side-by-side type conjugate filaments or fibers, sea-island type conjugate filaments or fibers or sectional multi-foliate type conjugate filaments or fibers, in each of which a part of the surface of the filaments or fibers is composed of the low melting point polymer, may be also employed.

The number of loops formed on the surface of the nonwoven base is preferred to be sufficient for maintaining not less than 35 gf/cm in peeling strength and not less than 200 gf/cm$^2$, more preferably, not less than 400 gf/cm$^2$ in shearing strength, even after repeating the joining and peeling 4 times. The peeling strength and shearing strength are evaluated by the method mentioned in the later-described examples. As a matter of course, because the peeling strength and shearing strength are variable depending on the kind and quantity of the antislipping agent applied on the surface of the loop or on the extent and number of unevenness on the surface of the loop or on the type of the hook material, the number of the loops may be appropriately decided by taking the mentioned factors into consideration. Generally, the number of loops is preferably not less than 30 loops/cm$^2$ when observed by a microscopic photograph. The length of the loop, i.e., the length of the semi-annular portion protruding out of the surface of the nonwoven base is preferably about 0.5 to 8 mm when observed by a microscopic photograph.

In the present invention, the loops are generally formed on the surface of the nonwoven base at random. More specifically, the loops are not formed regularly with a certain distance in a certain direction, but formed freely with random distances in random directions. By forming the loops at random, irrespective of the shape of the projections (mushroom-shaped projections or hook-shaped projections) formed on the hook material, almost desirable joining strength (high peeling strength and high shearing strength) can be obtained. If the loops are formed with a regularity, it is certain that a strong joining strength is obtained when the loops are engaged with projections conforming to such regularity, but any desirable joining strength cannot be obtained when the loops are engaged with a hook material having projections not conforming to the regularity.

In the loops formed on the loop material of a hook-and-loop fastener according to the present invention, since the antislipping agent is deposited at least on one part of the surface of the loop, or unevenness are formed on the surface of the loop by softening or melting the low melting point polymer, when such loops are engaged with the projections of the hook material the coefficient of friction between the projections and the loops is increased, whereby the loops and the projections are hardly disjoined from each other.

Accordingly, by joining the loop material according to the present invention with the hook material, it becomes possible to stronglyjoin the fastening part of disposable goods such as diapers, operating gowns join or various other goods, thus an advantage is such that the fastening part is hardly disjoined during use. Furthermore, since the loop material according to the present invention is made of a nonwoven fabric, a reasonable price is achieved, though the joining durability thereof may be inferior to woven or knitted fabric. Accordingly, the loop material according to the present invention is suitable for disposable goods in which a high joining durability is not required but a cheaper price is important.

When bonding the filaments or fibers to each other by applying the binder resin in the nonwoven base structure of the loop material according to the present invention, the stability of the nonwoven base structure is improved. Also in the case of employing the thermoplastic filaments or fibers, or the conjugate filaments or fibers composed of a high melting point polymer and a low melting point polymer which occupies at least one part of the surface of the filament of fiber, and heat-bonding the filaments or fibers existing on the non-loop side of the nonwoven base to each other, the stability of the nonwoven base structure is improved. In the case of employing both of the mentioned bonding methods, the stability of the nonwoven base structure is improved all the more. As a result of improving the physical stability of the nonwoven base structure, not only the loops themselves are stabilized and engagement durability is exhibited to a certain extent, but also the loop material becomes easy to handle.

One manufacturing process of the loop material of a hook-and-loop fastener according to the present invention comprises basically the steps of forming a nonwoven web by accumulating a large number of filaments or fibers, forming loops on the nonwoven web by needle punching, etc., and depositing an antislipping agent on the surface of the loop.

For forming the nonwoven web, any of the conventionally known means may be employed. Also in the needle punching, any of the conventionally known means may be employed. Whether a barb needle (needle with barbs) or a fork needle (needle without barb and of which front end is like a fork) is employed, and the loops are formed on the anti-punched surface (a surface opposite to the side above which a punching needle is positioned). Punching density (the number of times that the needle punches through the nonwoven web, and referred to as the number of times/cm$^2$) at the time of needle punching is preferably 30 to 180 times/cm$^2$ and, more preferably, 40 to 120 times/cm$^2$. If the punching density is more than 180 times/cm$^2$, the number of times that the needle punches through the web is excessively large, and the loops once formed are easy to be broken. On the other hand, if the punching density is less than 30 times/cm$^2$, the number of the loops is excessively small, and any desired joining strength may not be obtained. Then, for depositing the antislipping agent on the surface of the loop formed in this manner, it is possible to employ a method of spraying an antislipping agent solution on the surface of the loop and drying it, or a method of impregnating the entire nonwoven web after the needle-punching into an antislipping agent solution and drying it, or a method of bringing the surface of the loop into contact with a roller surface of which is coated with an antislipping agent solution and drying it (so-called "coating method with a kiss roller"), etc.

It is also preferred to form the loops using a raising machine instead of or in combination with the needle punching. The raising machine forms the loops by hooking and pulling out the filaments or fibers on the nonwoven web. Accordingly, the surface on which the loops are formed becomes the surface treated by the raising machine. In case of using the raising machine, it is preferred that the filaments or fibers in the nonwoven web are fixed to each other to a certain extent by some means. If the filaments or fibers are not fixed to each other, there is a high possibility that the filaments or fibers on the surface of the nonwoven web are taken off by the raising machine.

Among the mentioned manufactuing processes, one of the most preferred manufacturing method is hereinafter described. This method is characterized by the steps of obtaining a nonwoven web by accumulating a large number of thermoplastic filaments; obtaining a nonwoven base precursor in which the thermoplastic filaments are entangled with each other, and forming a large number of loops only on one side of the nonwoven base precursor, by applying needle pinching to the nonwoven web; applying an antislipping agent on at least one part of a surface of the loops; and obtaining a nonwoven base by applying heat only to the other side (i.e., non-loop side) of the nonwoven base precursor, thereby bonding at least one part of the thermoplastic filaments forming the nonwoven base precursor to each other.

Figure 7:
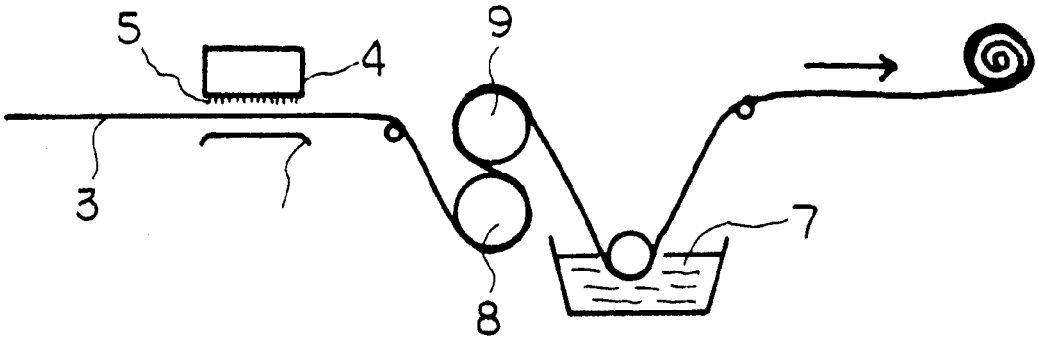
FIG. 7 is a schematic view showing an example of the manufacturing process of the loop material according to the present invention.
Figure 2:
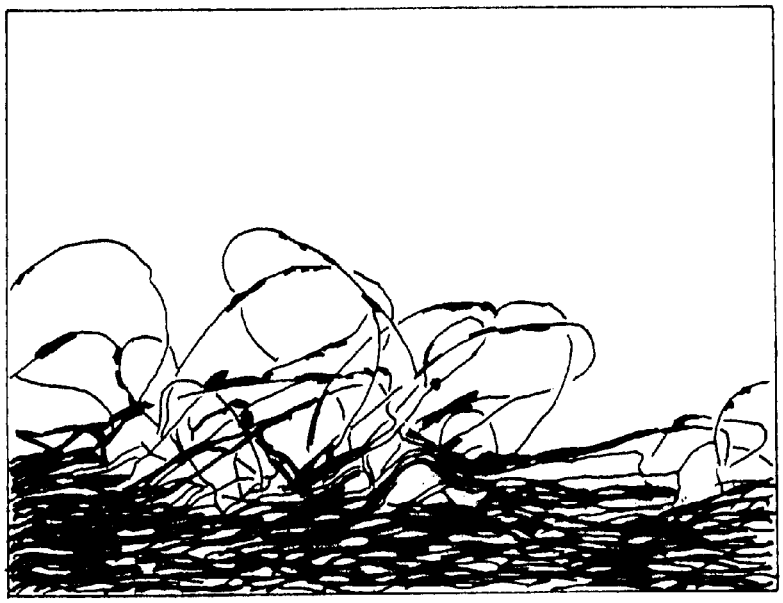
FIGS. 2 to 6 are schematic views of a microscopic photograph respectively showing the shape of filaments or fibers forming the loops of the loop material according to an example of the present invention.
Figure 3:
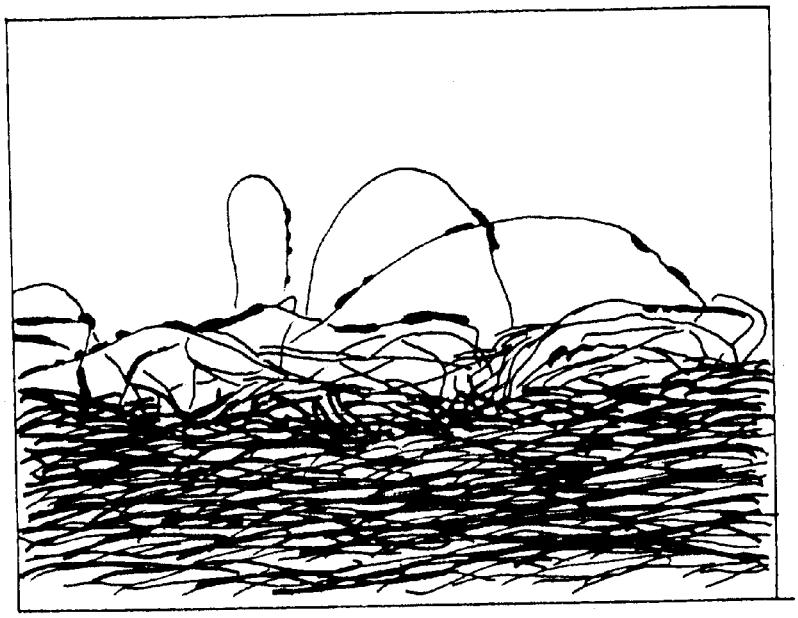
Figure 4:
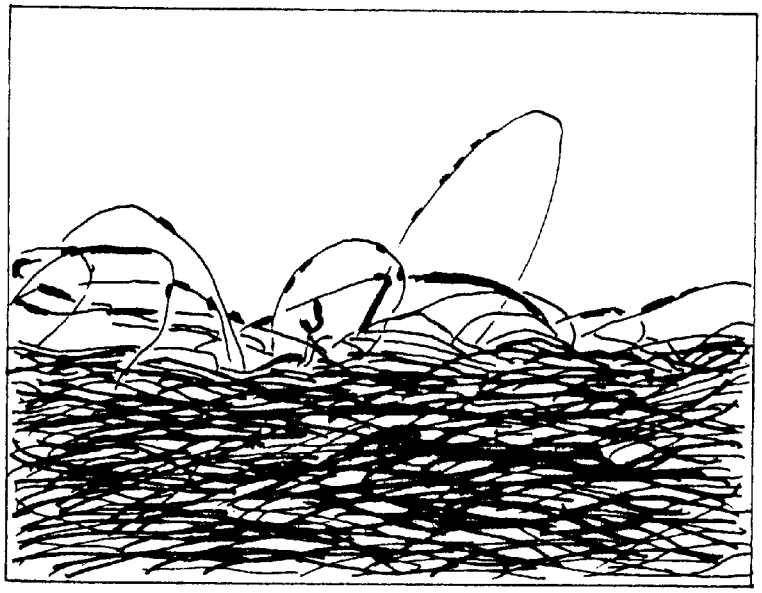
Figure 5:
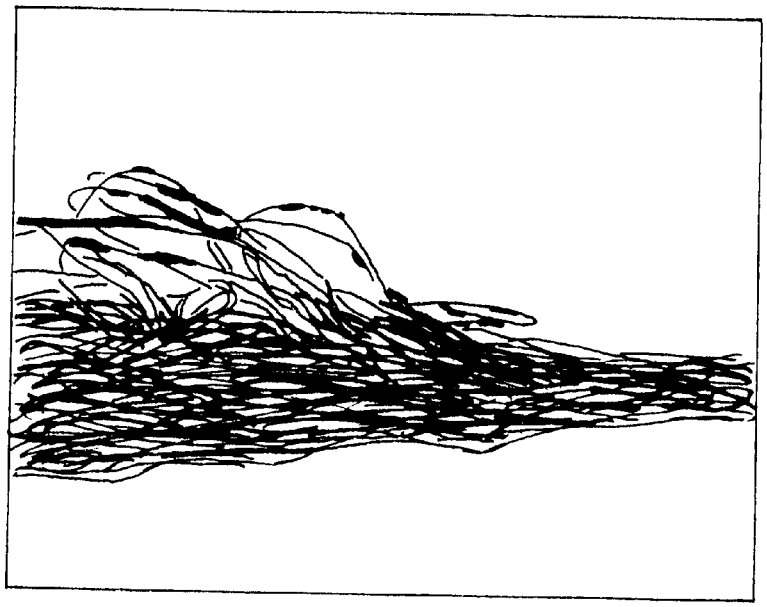
Figure 6:
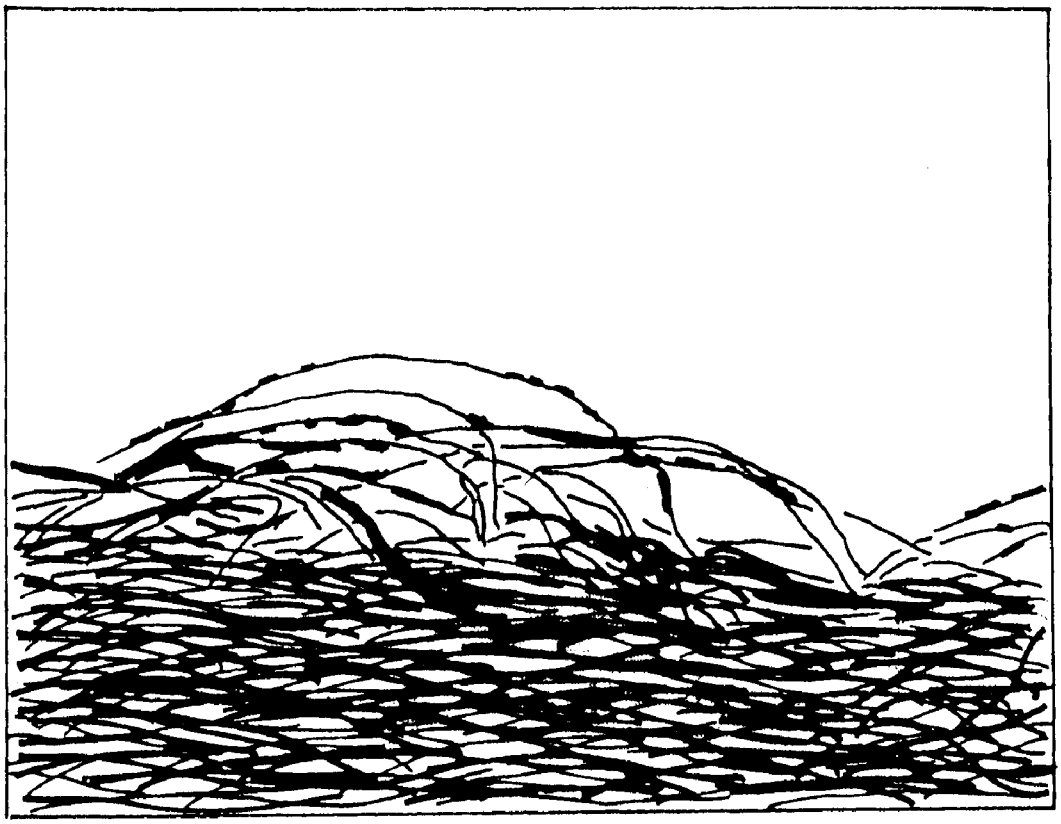
Figure 8:
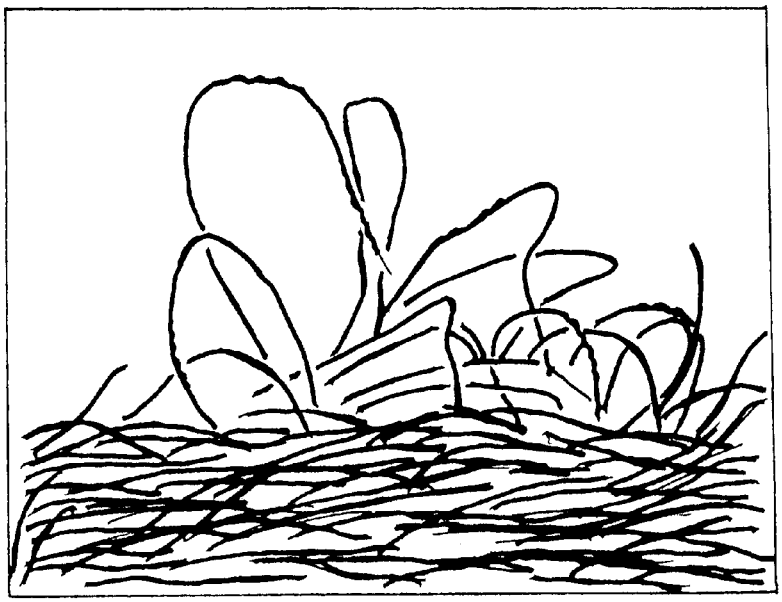
FIGS. 8 to 12 are schematic views of a microscopic photograph respectively showing a state of the filaments or fibers of the loops of the loop material according to an example of the present invention.
Figure 9:
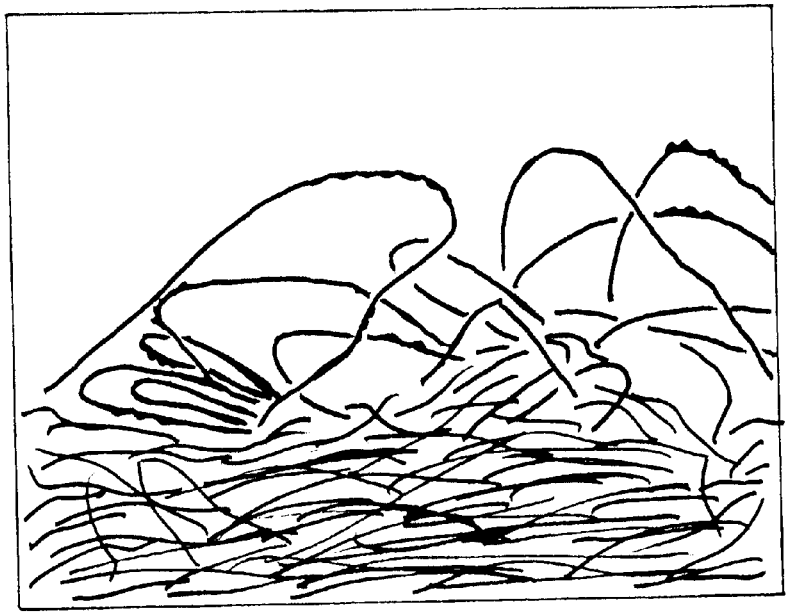
Figure 10:
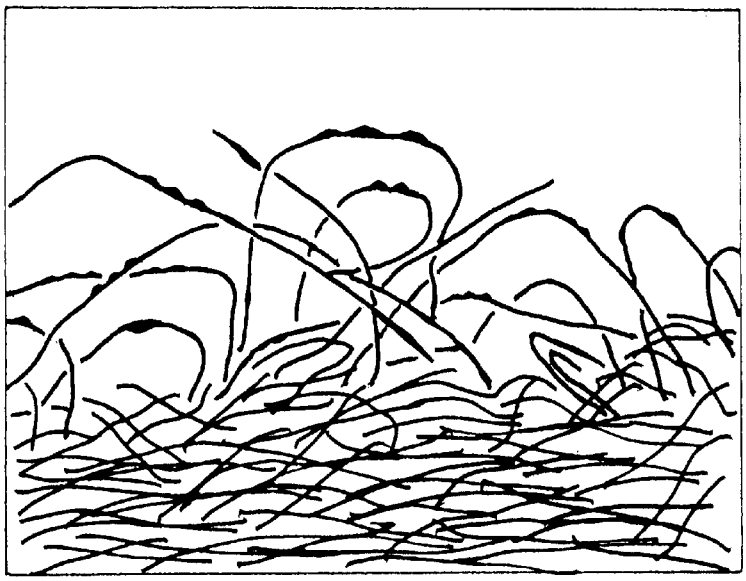
Figure 11:
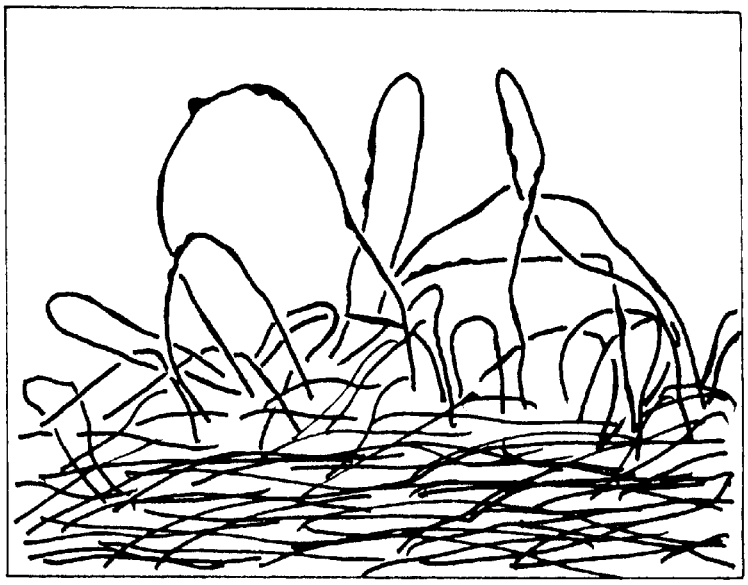
Figure 12:
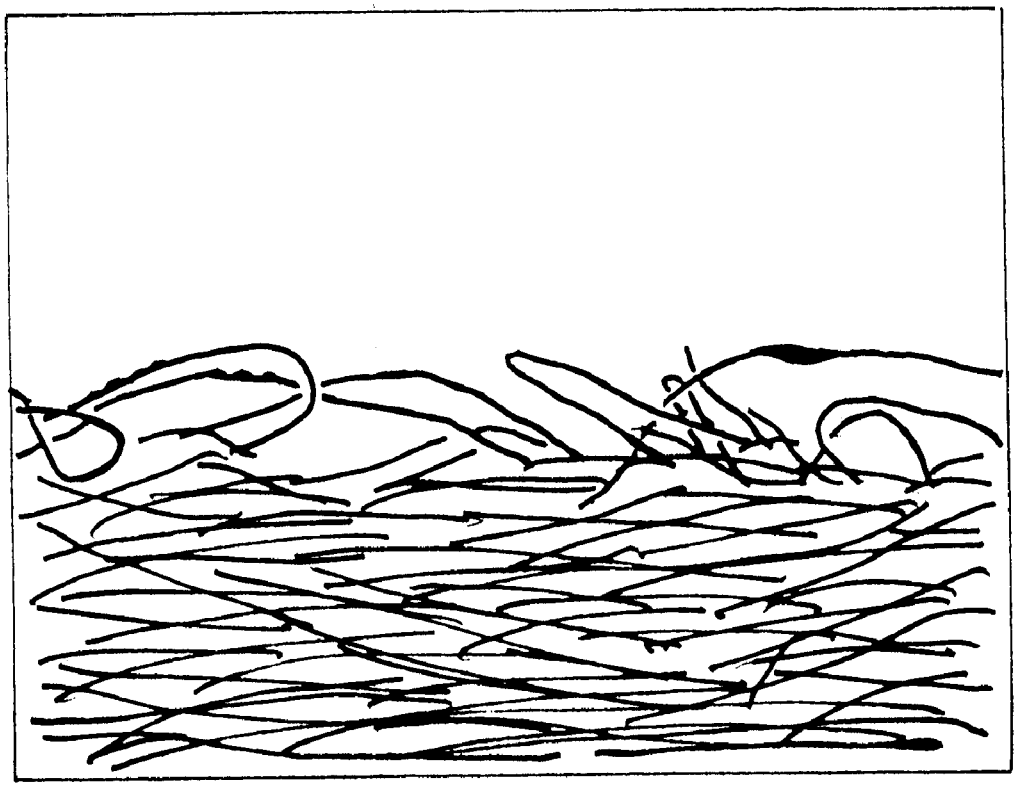

Describing more specifically the above method with reference to FIG. 7, first the thermoplastic filaments such as polyester filaments, polyamide filaments, polyolefin filaments are prepared. Then, by accumulating a large number of such thermoplastic filaments, a nonwoven web 3 is obtained. It is preferred that the nonwoven web 3 is formed by employing a process of spinning the thermoplastic filaments and accumulating them immediately (so-called spun bonded process).

Then, needle punching is applied to the nonwoven web 3. In the needle punching, a needle board 4 in which needles 5 are set up is moved up and down, whereby the needles 5 thrust through the nonwoven web 3. Reference numeral 6 indicates a perforated screen for supporting the nonwoven web 3. Pores of the perforated screen 6 are provided corresponding to the needles so as to receive the needles 5 coming out to the back side passing through the nonwoven web 3. By this needle punching, loops are formed on one side of the nonwoven web 3. As described above, the loops are formed on the opposite side above which the needles are positioned, whether a barb needle or a fork needle is employed. When applying the needle punching to the nonwoven web 3, the filaments in a body of the nonwoven web except the loops are entangled with each other, whereby a nonwoven base precursor having a certain tensile strength is obtained.

Thereafter, by applying heat only to the non-loop side of the nonwoven base precursor, the thermoplastic filaments are softened or molten, whereby the thermoplastic filaments are at least partially heat-bonded to each other. More specifically, this is achieved by employing any means for causing only the non-loop side to contact a heat roller. As described above, the non-loop side is surface on the side above which the needles are positioned, i.e., a surface on the upper side of the nonwoven web 3 in FIG. 7. Accordingly, supposing that a roller 9 is a roller of room temperature, and the roller 8 is a heating roller, the non-loop side is heated by the heating roller 8, and the thermoplastic filaments are heat-bonded to each other mainly on the non-loop side. A certain clearance is secured between the roller 8 and the roller 9 so that the loops formed by the needle punching may not be deformed due to heat or embedded in the nonwoven base.

Then, by dipping a material composed of the nonwoven base and the loops in the antislipping agent solution 7, the antislipping agent is applied to at least one part of each surface of the loops. The various polymers, copolymers or cross linked polymers thereof may be employed as the antislipping agent as described above, and they also serve as a binder resin. Accordingly, when applying the antislipping agent to each surface of the loops by the dipping process using a antislipping agent serving also as the binder resin, the antislipping agent (binder resin) is applied also to the nonwoven base at the same time. When the binder resin is applied to the nonwoven base, the filaments are bonded to each other by the binder resin, and the mechanical properties of the nonwoven base such as tensile strength are improved all the more. In effect, in the process shown in FIG. 7, the step of applying the binder resin to the thermoplastic filaments forming the nonwoven base, thereby bonding the thermoplastic filaments to each other, is integrally added to the step of applying the antislipping agent to each surface of the loops.

Further, though the antislipping agent is applied to each surface of the loops after passing through the material composed of the nonwoven base precursor and the loops between the roller 8 and the roller 9 in FIG. 7, it is also preferred that this step is reversed such that the material passes through between the roller 8 and the roller 9 after applying the antislipping agent. It is also preferred that at the same time as the application of the antislipping agent, the binder resin is applied to the nonwoven base precursor, and the thermoplastic filaments forming the nonwoven base precursor are bonded to each other by the binder resin. In any of the mentioned methods, by applying heat only to the non-loop side of the nonwoven base precursor, the thermoplastic filaments mainly forming the non-loop side are heat-bonded to each other, and a physical stability is given to them, whereby a nonwoven base is obtained. In the case that the binder resin is applied to the nonwoven base and the thermoplastic filaments are bonded to each other, a nonwoven base of superior physical stability is achieved. In this case, it is preferred that the binder resin is applied after the heat bonding, as shown in FIG. 7. Because as a result of heat bonding the thermoplastic filaments to each other, substantial intersections (cross points) among the filaments are increased, and when applying the binder resin under such a condition, the intersections are efficiently bonded, and it becomes easy to obtain a nonwoven base which is superior in physical stability. However, it is also preferred that the heat bonding is performed after applying the binder resin to the nonwoven base precursor, as described above.

On one side of the nonwoven base obtained as described above, a large number of loops are formed, and the antislipping agent is applied on at least one part of each surface of the loops. When press-joining such a loop material, made of a nonwoven fabric composed of the nonwoven base and the loops on each surface of which the antislipping agent is applied, to the hook material, coefficient of friction is large after engaging the projections of the hook material with the loops, and the loop material and the hook material are hardly disjoined from each other even when a relatively high shearing load is applied thereto. The loop material obtained by the method shown in FIG. 7 is generally formed into a roll, and accordingly, when actually applying the loop material to any disposable goods, the loop material is used in the form of a tape or a sheet having a certain shape, as a matter of course.

Another manufacturing process of the loop material of a hook-and-loop fastener according to the present invention is basically comprised of forming a nonwoven web by accumulating a large number of conjugate filaments or fibers each of which is composed of a high melting point polymer and a low melting point polymer occupying at least one part of the surface of the filament or fiber, and partially applying heat to the nonwoven web to soften or melt the low melting point polymer, thereby heat-bonding the conjugate filaments or fibers to each other, and forming loops by peeling the heat bond area of the conjugate filaments by such a means as a needle punching apparatus, raising machine, etc., whereby unevenness (due to softening or melting of the low melting point polymer) are formed on the surface of the loop which is composed of one part of the filaments or fibers having existed in the heat bond area. The means of forming the nonwoven web, the means of needle punching, punching density, etc. are the same as the foregoing manufacturing process.

Figure 13:
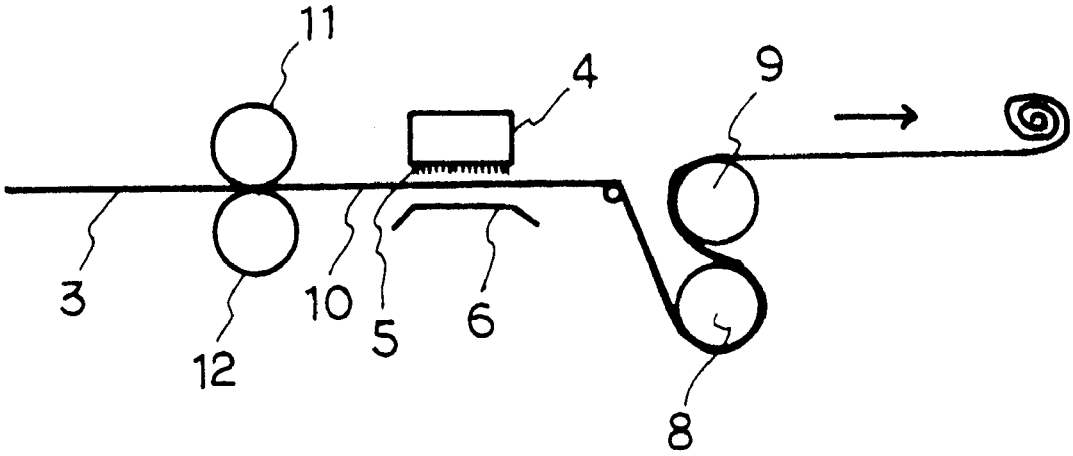
FIG. 13 is a schematic view showing another example of the manufacturing process of the loops material according to the present invention.

The most preferred method of the mentioned processes is hereinafter described with reference to FIG. 13. First, conjugate filaments composed of a high melting point polymer and a low melting point polymer which occupies at least one part of the surface of the filaments, are prepared. The manner of combination or conjugation of the high melting point polymer and the low melting point polymer is as described above, and in particular it is preferred to employ sheath-core type conjugate filaments of which a core component is composed of polyester and sheath component is composed of polyolefin. The nonwoven web 3 is obtained by accumulating a large number of such conjugate filaments. It is preferred that the nonwoven web 3 is formed by employing the steps of conjugating and spinning the high melting point polymer and the low melting point polymer, and accumulating them immediately (so-called spun bonded process).

Heat is partially applied to the nonwoven web 3. Then, at the portions where a heat is partially applied, the low melting point polymer exposed on each surface of the conjugate filaments is softened or molten, thereby forming temporary heat-bonded areas where the conjugate filaments are temporarily heat-bonded to each other. The temporary heat-bonded areas are dispersed in the nonwoven web, and are distributed with a certain distance between one and another. In this respect, it is preferred that the temperature for applying a heat to the nonwoven web 3 is within a temperature range which is lower than the melting point of the low melting point polymer. If the temperature is higher than the melting point of the low melting point polymer, the heat-bonding in the temporary heat-bonded areas becomes excessively strong, and the temporary heat bond is difficult to be peeled in the later needle punching step. On the other hand, if the temperature is excessively lower than the melting point of the low melting point polymer, deformation (formation of unevenness) of the low melting point polymer by softening or melting is small. Accordingly, it is preferred that the temperature at the time of applying heat to the nonwoven web 3 is in the range of (melting point of the low melting point polymer −15° C.) to (melting point of the low melting point polymer −45° C.).

For applying heat partially to the nonwoven web 3, either an embossing apparatus comprising an engraved roller 11. and a smooth roller 12 or an embossing apparatus comprising a pair of engraved rollers 11, 12 are employed, and by heating the engraved roller 11, non-engraved parts of the roller 11 are pressed on the nonwoven web 3. The non-engraved parts are dispersed on the surface of the engraved roller. At this time, it is preferred that the engraved roller 11 is heated to be lower than the melting point of the low melting point polymer within a certain temperature range, as mentioned above. The end face of each non-engraved part of the engraved roller 11 may be any shape such as round, ellipse, rhomboid, triangle, T-shape, #—shape, rectangle, etc.

The temporary heat-bonded areas may be also formed by using an ultrasonic bonding apparatus. By using an ultrasonic bonding apparatus, an ultrasonic wave is irradiated to predetermined areas of the nonwoven web 3, whereby the low melting point polymer is softened or molten by frictional heat among the conjugate filaments in that area. When applying heat partially to the nonwoven web 3 in the method mentioned above, the low melting point polymer exposed on each surface of the conjugate filaments is softened or molten, and the conjugate filaments are temporarily heat-bonded to each other, whereby a nonwoven fleece 10 in which the temporary heat-bonded areas are dispersed is obtained.

Then, needle punching is applied to the nonwoven fleece 10. The needle punching is performed in the same manner as the foregoing description with reference to FIG. 7. As a result, the temporary heat-bonding among the conjugate filaments is peeled in the temporary heat-bonded areas of the nonwoven fleece 10. More specifically, as a result of the needle punching, the conjugate filaments move in the vertical direction of the nonwoven fleece 10, whereby the temporary heat-bonded areas are broken, and the temporary heat-bonding among the conjugate filaments are peeled from each other. Thus, loops composed of each part of the conjugate filaments are formed on the surface opposite to the side above which the needles 5 are positioned. Since each temporary heat-bonding part in the conjugate filaments may be the loops, unevenness formed by softening or melting of the low melting point polymer (unevenness formed by the peeling of the temporary heat-bonding) remain on the loops. Further, when applying needle punching to the fleece 10, the conjugate filaments in the body of the nonwoven fleece are entangled with each other except the loop portions, and a nonwoven base precursor having a certain tensile strength is obtained.

Thereafter, by applying heat only to the non-loop side of the nonwoven base precursor, each low melting point polymer in the conjugate filaments is softened or molten again, whereby at least one part of the conjugate filaments are heat-bonded to each other. This process may be performed in the same manner as the foregoing description with reference to FIG. 7. For example, in the case of using the sheath-core type conjugate filament of which the core component is polyester and the sheath component is polyolefin, a non-loop side of very small coefficient of friction (not more than 0.08, for example) can be obtained as a result of the property of polyolefin. Further, in the case of using such sheath-core type conjugate filaments, a highly flexible loop material is obtained, for example, a loop material can be obtained the softness of which is not more than 700 g. In addition, it is also preferred that the conjugate filaments are bonded to each other by applying a binder resin in the nonwoven base precursor or the nonwoven base.

On one side of the nonwoven base obtained as described above, a large number of loops are formed, and on at least one part of the surface of the loop, unevenness are formed by softening or melting the low melting point polymer. When press-joining the loop material made of a nonwoven fabric comprising the loops having unevenness on their surface and the nonwoven base, to a hook material, coefficient of friction after engaging the loops with the projections of hook material is large, and the loop material and the hook material are hardly disjoined from each other even when a relatively high shearing load is applied thereto. The loop material obtained by the method shown in FIG. 13 is generally formed into a roll and accordingly, when actually applying the loop material to any disposable goods, the loop material is used in the form of a tape or a sheet of certain shape, as a matter of course.

In the several manufacturing processes described above, a following special process may be also employed as a method for forming the loops by applying needle punching to the nonwoven web. That is, a nonwoven web is prepared by piling a first layer composed of filaments or fibers of larger denier and a second layer composed of filaments or fibers of small denier. When applying needle punching from the first layer side to the second layer side, since the first layer is composed of the filaments or fibers of large denier, the needles selectively catch or hook the filaments of fibers of large denier. The filament or fibers of large denier caught by the needles pass through the second layer, whereby loops are formed on the surface of the second layer (non-punching side). Since the loops are formed of the filaments or fibers of large denier, rigidity is large as compared with the filaments or fibers of small denier, and therefore when the projections of the hook material engage with such loops, they are hardly disjoined from each other, thus a high joining strength is achieved. On the other hand, since the nonwoven base contains a relatively large amount of the small denier filaments or fibers, the structure of the nonwoven base becomes fine and close, which results in superior physical stability.

EXAMPLES

Several examples of the present invention are thereinafter described, and it is to be understood that the present invention is not limited to these examples. The present invention should be decided based on the technical idea that the projections of the hook material and the loops are hardly disjoined from each other as a result of forming the unevenness on the surface of the loop by depositing an antislipping agent or by softening or melting the low melting point polymer in the conjugate filaments. In addition, the evaluation method of the joining strength (peeling strength and shearing strength) of the loop material is carried out in accordance with the test method specified on JIS L 3416, as specifically described below.

(1) Peeling Strength (gf/cm)

A loop material of 25 mm in width and 100 mm in length (test piece) and a hook material (Mushroom tape produced by YKK) of same size as the loop material were prepared, and the hook material was exactly put on the loop material and press-joined by rolling twice a steel roller of 2.5 Kg on these materials so that a 50 mm length of each material occupying a half of the whole length were joined to each other. Then, using a Tensilon RTM-500 (produced by Toyo Baldwin), an end of the loop material and an end of the hook material not joined to each other were respectively caught by each chuck, and the loop material and the hook material were separated or peeled from each other by pulling each end making an angle of 90° with respect to the direction of the face, on the condition of 10 cm in distance between chucks and 30 cm/min in tension speed, thus a peeling strength was measured and obtained. A value shown at the time of disjoining the loop material and the hook material from each other was established to be a maximum peeling strength value. Further, to evaluate the joining durability, using the loop material and the hook material disjoined from each other after press joining, a peeling strength thereof was also measured and obtained. Thus, an original peeling strength was established to be a first peeling strength, and a peeling strength after joining and disjoining once was established to be a second peeling strength, thus each peeling strength up to a fifth joining and disjoining was measured and obtained.

(2) Shearing Strength (gf/cm$^2$)

The same loop material and hook material as those used in obtaining the peeling strength were prepared. A 50 mm length of a left end part of the loop material was put on a 50 mm length of a right end part of the hook material, and press-joined to each other in the same manner as the foregoing measurement of the peeling strength. Then, using the same Tensilon RTM-500 (produced by Toyo Baldwin) as that employed in the measurement of the peeling strength, the right end of the loop material and the left end of the hook material press-joined to each other were respectively caught by each chuck, and the loop material and the hook material were pulled in parallel in the direction of the face, on the condition of 10 cm in distance between chucks and 30 cm/min tension speed, thus a shearing strength was measured and obtained. A value shown at the time of disjoining the loop material and the hook material from each other was established to be a maximum shearing strength value. Further, to evaluate the joining durability, by using the loop material and the hook material disjoined from each other after press-joining, a shearing strength thereof was also measured and obtained. Thus, an original shearing strength was established to be a first shearing strength, and a shearing strength after joining and disjoining once was established to be a second shearing strength, thus each shearing strength up to a fifth joining and disjoining was measured and obtained.

Example 1

By accumulating polyethylene terephthalate filaments of 5 denier in fineness, a nonwoven web was prepared. Using a needle punching machine (of which needles were Crown barb needles produced by Foster), needle punching was applied to this nonwoven web at 120 times/cm$^2$ in punching density and 9 mm in needle depth, whereby the polyethylene terephthalate filaments were entangled and a nonwoven base precursor was obtained, and at the same time loops were formed by protruding each part of the filaments on one side of the nonwoven base precursor. Then, using a heat bonding apparatus comprising a pair of rollers disposed with a certain clearance therebetween, one of which is a heating roller heated to 230° C. and another is a roller at room temperature, the nonwoven base precursor was passed through between the pair of rollers in such a manner that the non-loop side of the nonwoven base precursor contacts the heating roller. As a result, the filaments existing on the non-loop side of the nonwoven base precursor are heat-bonded to each other, and a nonwoven base having a certain physical stability was obtained.

Thereafter, by dipping the nonwoven base and the loops in an emulsion of acrylic resin (an emulsion composed of polyacrylic acid polymer and cross linked material, "Voncoat" produced by Dainippon Ink & Chemicals, Inc.) serving as the antislipping agent and drying them, and on the condition that the amount of solid acrylic resin deposited on the loops may be 8% by weight, a loop material was obtained. In addition, about 8% by weight of solid acrylic resin was also applied in the nonwoven base, whereby the filaments are desirable bonded to each other. As a result, the physical stability of the nonwoven base was further improved. The joining strength (peeling strength and shearing strength) of the loop material obtained as described above was measured and is shown in Table 1. The fineness of the employed filaments, punching density in the needle punching, temperature of the heating roller, and amount of the antislipping agent deposited (deposit amount of antislipping agent with respect to the loops with antislipping agent) are also shown in Table 1.

TABLE 1

| | | Example | | | | |
|---|---|---|---|---|---|---|
| | | 1 | 2 | 3 | 4 | 5 |
| Filament fineness (denier) | | 5 | 5 | 5 | 5 | 8 |
| Punching density (times/cm$^2$) | | 120 | 240 | 40 | 120 | 120 |
| Temperature of heating roller (° C.) | | 230 | 230 | 230 | 230 | 240 |
| Deposit amount of antislipping agent (% by weight) | | 8 | 5 | 10 | 3 | 10 |
| Peeling strength (gf/cm) | 1st | 95 | 57 | 64 | 74 | 77 |
| | 2nd | 70 | 55 | 58 | 82 | 68 |
| | 3rd | 60 | 62 | 72 | 73 | 55 |
| | 4th | 60 | 50 | 50 | 70 | 62 |
| | 5th | 63 | 55 | 62 | 69 | 60 |
| Shearing Strength (gf/cm$^2$) | 1st | 1400 | 950 | 1030 | 930 | 1160 |
| | 2nd | 1400 | 920 | 1100 | 880 | 1350 |
| | 3rd | 1580 | 1040 | 990 | 850 | 1230 |
| | 4th | 1200 | 990 | 1000 | 930 | 1270 |
| | 5th | 810 | 1020 | 1060 | 1010 | 1500 |

Examples 2 to 5

In examples 2 and 3, a loop material was obtained in the same manner as the foregoing example 1 except that the punching density and the amount of antislipping agent deposited were changed as shown in Table 1. In example 4, a loop material was obtained in the same manner as the foregoing example 1 except that deposit amount of antislipping agent was changed as shown in Table 1. In example 5, a loop material was obtained in the same manner as the foregoing example 1 except that the fineness of polyethylene terephthalate filament, the temperature of the heating roller and the amount of antislipping agent deposited were changed as shown in Table 1. The peeling strength and the shearing strength of the loop materials according to examples 2 to 5 were obtained and shown in Table 1.

Examples 6 to 10

In Example 6, a loop material was obtained in the same manner as the foregoing example 1 except that the fineness of the polyethylene terephthalate filament, the punching density, the temperature of the heating roller and the amount antislipping agent deposited were changed as shown in Table 2. In examples 7, 8 and 9, a loop material was obtained in the same manner as the foregoing example 1 except that the punching density and the amount of antislipping agent deposited were changed as shown in Table 2. In example 10, a loop material was obtained in the same manner as the foregoing example 1 except that a heating roller is not used and the amount of antislipping agent deposited were changed as shown in Table 2. The peeling strength and the shearing strength of the loop materials according to examples 6 to 10 were obtained and shown in Table 2.

It is understood from the results of example 1 to 10 that the loop materials obtained according to examples 1 to 7 have almost satisfactory peeling strength and shearing strength. On the other hand, in the loop materials obtained according to example 8, since the amount of the antislipping agent deposited on the loop is small, both the peeling strength and the shearing strength are decreased. In the loop material obtained according to example 9, since the punching density is large, the loops once formed are broken, thereby decreasing the total number of loops, and both the peeling strength and the shearing strength are largely decreased. In the loop material obtained according to example 10, since the heating roller was not employed for heat-bonding the filaments to each other, physical stability is poor, and both peeling strength and shearing strength will be largely decreased due to a change in the shape of the loop material after repeated use. However, depending upon the way of use, the loop materials obtained according to examples 8 to 10 may be satisfactory. That is, in the case that a high peeling strength and shearing strength are not required, or in the case that sufficient peeling strength and shearing strength are achieved depending upon the hook material, those loop materials obtained according to examples 8 to 10 can be put into practical use.

TABLE 2

| | | Example | | | | |
|---|---|---|---|---|---|---|
| | | 6 | 7 | 8 | 9 | 10 |
| Filament fineness (denier) | | 3 | 5 | 5 | 5 | 5 |
| Punching density (times/cm$^2$) | | 90 | 20 | 90 | 260 | 120 |
| Temperature of heating roller (° C.) | | 220 | 230 | 230 | 230 | — |
| Deposit amount of antislipping agent (% by weight) | | 10 | 10 | 2 | 10 | 15 |
| Peeling strength (gf/cm) | 1st | 82 | 45 | 15 | 15 | 82 |
| | 2nd | 79 | 34 | 13 | 13 | 50 |
| | 3rd | 70 | 42 | 13 | 14 | 32 |
| | 4th | 59 | 37 | 11 | 13 | 30 |
| | 5th | 87 | 39 | 17 | 13 | 25 |
| Shearing strength (gf/cm$^2$) | 1st | 1240 | 910 | 620 | 210 | 1020 |
| | 2nd | 1152 | 870 | 550 | 200 | 880 |
| | 3rd | 1460 | 800 | 440 | 170 | 700 |
| | 4th | 1460 | 820 | 340 | 140 | 520 |
| | 5th | 1420 | 820 | 330 | 120 | 440 |

Example 11

A polyethylene terephthalate, the limiting viscosity of which was 0.64 and the melting point was 256° C., was prepared as a core component (high melting point polymer). A high density polyethylene, the melt index value of which was 25 g/10 min (measured in accordance with the method described in ASTM D1238(E)) and the melting point was 130° C., was prepared as a sheath component (low melting point polymer). These two polymers are guided into a spinneret provided with holes to spin the conjugate filament by using a separate extruder. At this time, the molten polyethylene terephthalate was guided to a core part of the hole.to spin conjugate filament, and the molten high density polyethylene was guided to a sheath part of the hole. And by providing both components in each hole on the condition that a ratio by weight between the core component and the sheath component are equivalent, a melt spinning of the conjugate filament was performed. The filaments spun out of the spinneret were cooled, diffused, and accumulated on a moving screen conveyor of wire gauze, whereby a nonwoven web of 70 g/m$^2$ was obtained. The fineness of the sheath-core type conjugate filament forming this nonwoven web was 5 denier.

Then, this nonwoven web was guided between an engraved roller heated to 100° C. and a smooth roller heated to 100° C. As a result, portions of the nonwoven web contacting the non-engraved parts of the engraved roller were partially heated, and each sheath component of the conjugate filaments was softened or molten, thus the conjugate filaments were temporarily heat-bonded to each other. In this manner, a nonwoven fleece in which the temporary heat-bonded areas were dispersed was obtained. A size of each temporary heat-bonded area was 0.6 mm$^2$, the density of the temporary heat-bonded areas in the nonwoven fleece was 20 numbers/cm$^2$, and the total size of the temporary heat-bonded areas was 15% of the surface area of the nonwoven fleece.

Using a needle punching machine (the punching needles of which were Crown barb needles produced by Foster), needle punching was applied to this nonwoven fleece at 120 times/cm$^2$ in punching density and 9 mm in needle depth, whereby the temporary heat-bonding of the conjugate filaments was peeled, and by entangling the conjugate filaments with each other, a nonwoven base precursor was obtained. At this time, loops were formed by protruding each part of the conjugate filaments on the nonwoven base precursor. Then, using a heat bonding apparatus comprising a pair of rollers disposed with a certain clearance therebetween one of which is a heating roller heated to 120° C. and the other is a roller at room temperature, the nonwoven base precursor was passed through between the pair of rollers in such a manner that the non-loop side of the nonwoven base precursor contacts the heating roller. As a result, the filaments existing on the non-loop side of the nonwoven base precursor are heat-bonded to each other by the softening and melting of the high density polyethylene, and a nonwoven base having a certain physical stability was obtained. The joining strength (peeling strength and shearing strength) of the loop material obtained as described above was measured and are shown in Table 3. In addition to the fineness of the employed filaments, the ratio by weight between the core component and the sheath component [core/sheath (ration)], the punching density in the needle punching, the temperature of the heating roller, the softness (g) of the loop material and the coefficient of friction of the non-loop side also shown in Table 3.

TABLE 3

| | | Example | | | |
|---|---|---|---|---|---|
| | | 11 | 12 | 13 | 14 |
| Filament fineness (denier) | | 5 | 5 | 5 | 8 |
| Core/sheath (ratio) | | 1/1 | 1/1 | 1/1 | 1/0.3 |
| Punching density (times/cm$^2$) | | 120 | 240 | 40 | 120 |
| Temperature of heating roller (° C.) | | 120 | 125 | 120 | 125 |
| Peeling strength (gf/cm) | 1st | 120 | 67 | 63 | 67 |
| | 2nd | 105 | 61 | 68 | 68 |
| | 3rd | 83 | 54 | 52 | 73 |
| | 4th | 70 | 52 | 42 | 62 |
| | 5th | 59 | 55 | 40 | 56 |
| Shearing strength (gf/cm$^2$) | 1st | 730 | 850 | 1130 | 1100 |
| | 2nd | 800 | 800 | 790 | 920 |
| | 3rd | 1120 | 720 | 830 | 830 |
| | 4th | 1250 | 960 | 820 | 880 |
| | 5th | 840 | 990 | 990 | 720 |
| Coefficient of friction | | 0.072 | 0.060 | 0.065 | 0.071 |
| Softness (g) | | 520 | 630 | 490 | 580 |

In this respect, the coefficients of friction sown in Tables 3, 4 and 5 are those of the non-loop side of the loop material (test piece) measured by using a friction tester (KES-SE) produced by Katotech Co., Ltd. Each coefficient of friction shown in the tables is an average value obtained after performing the measurement five times. The softness (g) was measured in the following manner. That is, by rolling a test piece of 100 mm in width and 50 mm in length in the direction of width and fastening two ends with an adhesive tape, a cylindrical test piece was formed. Using a Tensilon TRM-500 produced by Toyo Baldwin, this cylindrical test piece was compressed by a compressing cell of 10 cm in diameter at a speed of 5 cm/min in the axial direction of the cylindrical test piece, and a maximum strength value thus obtained was established to be the softness. Each softness shown in the tables is an average value obtained after performing the measurement five times.

Examples 12 to 10

In example 12, a loop material was obtained in the same manner as the foregoing example 11, except that the punching density and the temperature of the heating roller were changed as shown in Table 3. In example 13, a loop material was obtained in the same manner as the foregoing example 11, except that the punching density was changed as shown in Table 3. In example 14, a loop material was obtained in the same manner as the foregoing example 11, except that the fineness of the conjugate filaments, the ratio by weight between the core component and the sheath component, and the temperature of the heating roller were changed as shown in Table 3. In example 15, a loop material was obtained in the same manner as the foregoing example 1, except that the fineness of the conjugate filament, the ratio by weight between the core component and the sheath component, the punching density, and the temperature of the heating roller were changed as shown in Table 4. In example 16, a loop material was obtained in the same manner as the foregoing example 11, except that the punching density and the temperature of the heating roller were changed as shown in Table 4. In examples 17 and 18, a loop material was obtained in the same manner as the foregoing example 11, except that the ratio by weight between the core component and the sheath component, punching density, and temperature of the heating roller were changed as shown in Table 4. In example 19, a loop material was obtained in the same manner as the foregoing example 11, except that the punching density and the temperature of the heating roller were changed as shown in Table 5. The joining strength (peeling strength and shearing strength), etc. of each loop material obtained according to examples 12 to 19 were measured and are shown in Tables 3, 4 and 5.

TABLE 4

| | | Example | | | |
|---|---|---|---|---|---|
| | | 15 | 16 | 17 | 18 |
| Filament fineness (denier) | | 3 | 5 | 5 | 5 |
| Core/sheath (ratio) | | 1/2 | 1/1 | 1/6 | 1/0.2 |
| Punching density (times/cm$^2$) | | 90 | 15 | 90 | 90 |
| Temperature of heating roller (° C.) | | 125 | 125 | 125 | 125 |
| Peeling strength (gf/cm) | 1st | 126 | 45 | 45 | 33 |
| | 2nd | 121 | 34 | 23 | 16 |
| | 3rd | 88 | 42 | 18 | 14 |
| | 4th | 72 | 37 | 20 | 21 |
| | 5th | 60 | 39 | 18 | 23 |
| Shearing strength (gf/cm$^2$) | 1st | 1040 | 910 | 1100 | 1020 |
| | 2nd | 1025 | 870 | 420 | 340 |
| | 3rd | 930 | 800 | 380 | 140 |
| | 4th | 880 | 820 | 350 | 60 |
| | 5th | 860 | 820 | 200 | 130 |
| Coefficient of friction | | 0.059 | 0.073 | 0.066 | 0.145 |
| Softness (g) | | 680 | 650 | 750 | 350 |

TABLE 5

| | | Example 19 |
|---|---|---|
| Filament fineness (denier) | | 5 |
| Core/sheath (ratio) | | 1/1 |
| Punching density (times/cm$^2$) | | 280 |
| Temperature of heating roller (° C.) | | 125 |
| Peeling strength (gf/cm) | 1st | 6 |
| | 2nd | 12 |
| | 3rd | 8 |
| | 4th | 15 |
| | 5th | 13 |
| Shearing strength (gf/cm$^2$) | 1st | 160 |
| | 2nd | 150 |
| | 3rd | 140 |
| | 4th | 140 |
| | 5th | 130 |
| Coefficient of friction | | 0.072 |
| Softness (g) | | 630 |

It is understood from the results of examples 11 to 19 that the loop materials obtained according to examples 11 to 15 have almost satisfactory peeling strength and shearing strength. On the other hand, in the loop materials obtained according to example 16, since the punching density is small, the number of the total loops are decreased, and both the peeling strength and the shearing strength are decreased. In the loop material obtained according to example 17, since the weight of the sheath component is excessively large as compared with that of the core component, we guess that the entire conjugate filaments are deformed and unevenness are difficult to produce on the surface, and therefore both the peeling strength and the shearing strength are decreased. In the loop material obtained according to example 18, since the weight of the sheath component is excessively small as compared with that of the core component, we guess that the deformation amount of the low melting point polymer in the conjugate filament is small and unevenness is difficult to produce on the surface. Therefore, both peeling strength and shearing strength will be largely decreased. In the loop material obtained according to example 19, since the punching density is excessively large, the loops once formed are broken, thereby decreasing the total number of loops, and both the peeling strength and the shearing strength are decreased. However, depending upon use, the loop materials obtained according to examples 16 to 19 may be satisfactorily used. That is, in the case that high peeling strength sand shearing strength are not required, or in the case that sufficient peeling strength and shearing strength are achieved depending upon the hook material, those loop materials obtained according to examples 16 to 19 can be put into practical use.

What is claimed is:

1. A loop material of a hook-and-loop fastener, comprising:

a nonwoven base formed by accumulating conjugate filaments or fibers composed of a high melting point polymer and a low melting point polymer forming at least one part of the surface of said conjugate filaments or fibers;

a plurality of loops formed by partially protruding said conjugate filaments or fibers on at least one plane side of said nonwoven base; and an unevenness formed on at least one part of each surface of said loops when bond breaking occurs during the formation of said loops to each of said conjugate filaments or fibers which are temporarily heat bonded by softening or melting of said low melting point polymer.

2. A loop material of the hook-and-loop fastener as defined in claim 1, in which the conjugate filaments or fibers are sheath-core type conjugate filaments or fibers the core component of which is a polyester being a high melting point polymer, and the sheath component is a polyolefin being a low melting point polymer.

3. A loop material of the hook-and-loop fastener as defined in claim 1, wherein said unevenness exists where said bond breaking occurs.

4. A loop material of a hook-and-loop fastener, comprising:

a nonwoven base having an accumulation of conjugate filaments or fibers, composed of a high melting point polymer and a low melting point polymer;

a plurality of loops formed by the protrusion of said conjugate filaments or fibers on at least one plane side of said nonwoven base; and an unevenness formed on at least one part of each surface of said loops when bond breaking occurs during formation of said loops to said conjugate filaments or fibers subsequent to being temporarily heat bonded by softening or melting of said low melting point polymer and compressed.

5. A loop material of a hook-and-loop fastener as defined in claim 4, wherein said unevenness exists where said bond breaking occurs.

6. A loop material of a hook-and-loop fastener as defined in claim 5, wherein the number of loops is sufficient for maintaining a peeling strength of not less than 35 gf/cm.

7. A loop material of a hook-and-loop fastener as defined in claim 6, wherein the number of loops is sufficient for maintaining a shearing strength of not less than 200 gf/cm$^2$.

8. A loop material of a hook-and-loop fastener as defined in claim 6, wherein the number of loops is not less than 30 loops/cm$^2$.

9. A loop material of a hook-and-loop fastener as defined in claim 8, wherein the length of the loop protruding out of the surface of said nonwoven base is about 0.5 to 8 mm.

10. A loop material of a hook-and-loop fastener as defined in claim 4, wherein the conjugate filaments or fibers are sheath-core type conjugate filaments or fibers, the core component of which is a polyester being a high melting point polymer, and the sheath component is a polyolefin being a low melting point polymer.

11. a process of manufacturing a loop material of a hook-and-loop fastener, comprising the steps of:

obtaining a nonwoven web by accumulating a plurality of conjugate filaments each of which is composed of a high melting point polymer and a low melting pont polymer forming at least one part of the surface of said conjugate filaments;

obtaining a nonwoven fleece in which temporary heat-bonded areas where said conjugate filaments are temporarily heat-bonded to each other by softening or melting of said low melting point polymer are dispersed, by applying heat partially to said nonwoven web;

obtaining a nonwoven base precursor in which said conjugate filaments are entangled with each other, and forming a plurality of loops, on each surface of which unevenness are produced by softening or melting of said low melting point polymer, only on one plane side of said nonwoven base precursor, while peeling said temporary heat-bonded areas, by applying needle punching to said nonwoven fleece; and obtaining a nonwoven base by applying heat only to the other plane side of said nonwoven base precursor and softening or melting said low melting point polymer, thereby heat-bonding at least on part of said conjugate filaments forming said nonwoven base precursor to each other.

* * * * *